US009349321B2

(12) United States Patent
Chen

(10) Patent No.: US 9,349,321 B2
(45) Date of Patent: May 24, 2016

(54) PIXEL CIRCUIT AND DISPLAY

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventor: Junsheng Chen, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 14/366,417

(22) PCT Filed: Dec. 12, 2013

(86) PCT No.: PCT/CN2013/089308

§ 371 (c)(1),
(2) Date: Jun. 18, 2014

(87) PCT Pub. No.: WO2015/032148

PCT Pub. Date: Mar. 12, 2015

(65) Prior Publication Data

US 2015/0213761 A1 Jul. 30, 2015

(30) Foreign Application Priority Data

Sep. 6, 2013 (CN) ..... 2013 1 0404138

(51) Int. Cl.
*G09G 3/32* (2006.01)

(52) U.S. Cl.
CPC ..... *G09G 3/3258* (2013.01); *G09G 3/3266* (2013.01); *G09G 3/3291* (2013.01); (Continued)

(58) Field of Classification Search
CPC ..... G09G 3/3258; G09G 3/3291; G09G 2300/043; G09G 2300/0465; G09G 2300/0852; G09G 2310/027; G09G 3/32; G09G 3/3266; G09G 2320/0204
USPC ..... 345/76, 78, 82, 90, 204; 315/51, 169.3
See application file for complete search history.

(56) References Cited

U.S. PATENT DOCUMENTS

2006/0038757 A1* 2/2006 Lee ..... G09G 3/3233 345/77
2006/0103323 A1 5/2006 Eom et al.

(Continued)

FOREIGN PATENT DOCUMENTS

CN 1766972 A 5/2006
CN 1877667 A 12/2006

(Continued)

OTHER PUBLICATIONS

International Search Report mailed Apr. 14, 2014; PCT/CN2013/089308.

(Continued)

*Primary Examiner* — Amare Mengistu
*Assistant Examiner* — Stacy Khoo
(74) *Attorney, Agent, or Firm* — Ladas & Parry LLP

(57) ABSTRACT

A pixel circuit and a display are configured to reduce a size of the pixel circuit, so as to further reduce pixel pitch, increase the number of the pixels contained in per unit area and improve picture display quality. The pixel circuit includes: a first pixel sub-circuit and a second pixel sub-circuit, as well as an initialization module (31) and a data voltage writing module (32) connected to the first pixel sub-circuit and the second pixel sub-circuit; wherein the initialization module (31) is connected to a reset signal terminal and a low potential terminal, and is configured to initialize the first pixel sub-circuit and the second pixel sub-circuit under the control of a reset signal inputted from the reset signal terminal; the data voltage writing module (32) is connected to a data voltage terminal and a gate signal terminal, and is configured, under the control of a signal inputted from the gate signal terminal, to firstly write a first data voltage to the first pixel sub-circuit and the second pixel sub-circuit and perform compensation on a driving module (332) of the second pixel sub-circuit, and then to write a second data voltage to the first pixel sub-circuit and perform compensation on a driving module (331) of the first pixel sub-circuit.

19 Claims, 9 Drawing Sheets

(52) U.S. Cl.
CPC .. *G09G2300/043* (2013.01); *G09G 2300/0465* (2013.01); *G09G 2300/0852* (2013.01); *G09G 2310/027* (2013.01); *G09G 2320/0204* (2013.01)

(56) References Cited

U.S. PATENT DOCUMENTS

| | | | | |
|---|---|---|---|---|
| 2006/0114193 | A1 | 6/2006 | Kwak et al. | |
| 2007/0029465 | A1 | 2/2007 | Choi et al. | |
| 2007/0046581 | A1 * | 3/2007 | Kwak ..... | G09G 3/006 345/68 |
| 2008/0048946 | A1 * | 2/2008 | Kwak ..... | G09G 3/006 345/76 |
| 2010/0156875 | A1 | 6/2010 | Kim et al. | |
| 2010/0201674 | A1 | 8/2010 | Kim et al. | |

FOREIGN PATENT DOCUMENTS

| | | | |
|---|---|---|---|
| CN | 101075410 | A | 11/2007 |
| CN | 101763819 | A | 6/2010 |
| CN | 101800026 | A | 8/2010 |
| CN | 203480807 | U | 3/2014 |
| EP | 2216770 | A1 | 8/2010 |
| JP | 2009-222779 | A | 10/2009 |

OTHER PUBLICATIONS

Written Opinion of the International Searching Authority dated Aug. 4, 2014; PCT/CN2013/089308.

USPTO NFOA dated Nov. 23, 2015 in connection with U.S Appl. No. 14/366,141.

International Search Report Appln. No. PCT/CN2013/089302; Dated Apr. 16, 2014.

Written Opinion of the International Searching Authority Appln. No. PCT/CN2013/089302; Dated Apr. 16, 2014.

First Chinese Office Action Appln. No. 201310404331.7; Dated Jan. 23, 2015.

* cited by examiner

PIXEL CIRCUIT AND DISPLAY

TECHNICAL FIELD

The present disclosure relates to the technical field of display, and more particularly, to a pixel circuit and a display.

BACKGROUND

Array substrates of existing high-end active matrix organic light emitting diode (AMOLED) products with medium or small size mostly employ a technical process of low temperature poly-silicon (LTPS). However, fluctuation of LTPS process will lead to drift of the threshold voltage of a thin film transistor (TFT) device, rendering current for driving organic light emitting diode (OLED) device unstable, thus resulting in a decrease in the display quality of pictures. A pixel compensation circuit in the prior art is a 6T1C circuit (a circuit formed by six thin film transistors and one capacitor), and the circuit diagram is shown in FIG. 1, where VDD is a high voltage level signal, VSS is a low voltage level signal, Data is a data signal, Gate is a gate control signal, Reset is an initialization control signal, Vinit is an initialization voltage level signal, EM is a signal for controlling light emission of OLED and is provided by a light emission circuit of the OLED panel. However, it is not easy to dispose six thin film transistors and one capacitor in one pixel. It is required the TFT devices to be made very small, and thus requirements for performance of the TFT devices are also relatively high. On the other hand, the arrangement of six thin film transistors and one capacitor in a pixel also causes a pixel pitch to be unable to be further decreased.

As shown in FIG. 2, for the 6T1C circuit in the prior art, elements which are needed to be disposed on a horizontal direction of two pixels include two data signal lines (Data v1 and Data v2), twelve TFTs, two capacitors, one gate control signal Gate line, one light emission control signal EM line, one high voltage level signal VDD line, one initialization voltage level signal Vinit line, and one initialization control signal Reset line. In FIG. 2, there are two organic light-emitting diodes, OLED 1 and OLED 2, and each of the cathodes thereof is connected to a low voltage level signal VSS line. FIG. 2 is a schematic circuit diagram of two pixels arranged in the horizontal direction. The arrangement of the pixels in the vertical direction is similar to the arrangement of the pixels in the horizontal direction, the elements that are needed to be disposed in two pixels arranged in the vertical direction include one data signal line, twelve TFTs, two capacitors, two gate control signal lines, one light emission control signal line, one high voltage level signal line and one initialization voltage level signal line.

As described above, in the prior art, it is needed to dispose 12 TFTs and two capacitors in two pixels.

SUMMARY

In embodiments of the present disclosure, there is provided a pixel circuit for reducing a size of the pixel circuit, so as to further reduce pixel pitch, increase the number of the pixels contained in per unit area and improve picture display quality. Further, in the embodiments of the present disclosure, there is further provided a display.

The pixel circuit provided in accordance with an embodiment of the present disclosure comprises a first pixel sub-circuit and a second pixel sub-circuit, as well as an initialization module and a data voltage writing module connected to the first pixel sub-circuit and the second pixel sub-circuit.

The initialization module is connected to a reset signal terminal and a low potential terminal, and is configured to initialize the first pixel sub-circuit and the second pixel sub-circuit under the control of a reset signal inputted from the reset signal terminal.

The data voltage writing module is connected to a data voltage terminal and a gate signal terminal, and is configured to, under the control of a signal inputted from the gate signal terminal, firstly write a first data voltage to the first pixel sub-circuit and the second pixel sub-circuit and perform a compensation on a driving module of the second pixel sub-circuit, and then to write a second data voltage to the first pixel sub-circuit and perform a compensation on a driving module of the first pixel sub-circuit.

The pixel circuit provided in accordance with the embodiment of the present disclosure comprises the first pixel sub-circuit and the second pixel sub-circuit, as well as the initialization module and the data voltage writing module connected to the first pixel sub-circuit and the second pixel sub-circuit; the pixel circuit formed by the first pixel sub-circuit, the second pixel sub-circuit, the initialization module and the data voltage writing module can reduce the size of the pixel circuit, so as to further reduce the pixel pitch, increase the number of the pixels contained in per unit area and improve picture display quality.

Optionally, the first pixel sub-circuit comprises a first driving module, a first light emission module, a first threshold compensation module and a first light emission control module.

The first threshold compensation module is connected to the initialization module and is configured to be initialized under the control of an initialization signal outputted from the initialization module. The first threshold compensation module is connected to the first driving module, and is configured to perform threshold voltage compensation on the first driving module. The first light emission module is connected to the first light emission control module, and is configured to emit light for display under the control of the first driving module and the first light emission control module.

In this way, the first pixel sub-circuit formed by the first driving module, the first light emission module, the first threshold compensation module and the first light emission control module is easy to be implemented in design of the pixel circuit.

Optionally, the first threshold compensation module comprises a first storage capacitor and a fourth transistor; the first driving module comprises a fifth transistor; the first light emission control module comprises a seventh transistor and a ninth transistor; and the first light emission module comprises a first light-emitting diode.

In this way, the first pixel sub-circuit formed by the storage capacitor, the transistors and the light-emitting diode is easy to be implemented in design of the pixel circuit.

Optionally, one terminal of the first storage capacitor is connected to a high voltage level signal line, and the other terminal thereof is connected to the source of the fourth transistor. The gate of the fourth transistor is connected to the gate signal terminal, the source of the fourth transistor is connected to the initialization module, and the drain of the fourth transistor is connected to the drain of the fifth transistor. The gate of the fifth transistor is connected to the source of the fourth transistor, and the source of the fifth transistor is connected to the data voltage writing module. The gate of the seventh transistor is connected to a light emission control signal line, the source of the seventh transistor is connected to the high voltage level signal line, and the drain of the seventh transistor is connected to the source of the fifth transistor. The gate of the ninth transistor is connected to the light emission control signal line, the source of the ninth transistor is connected to the drain of the fifth transistor, and the drain of the ninth transistor is connected to the first light-emitting diode. The anode of the first light-emitting diode is connected to the drain of the ninth transistor, and the cathode of the first light-emitting diode is connected to a low voltage level signal line.

In this way, the connection relationship of the storage capacitor, the transistors and the light-emitting diode is easy to be implemented in design of the pixel circuit.

Optionally, the second pixel sub-circuit comprises a second driving module, a second light emission module, a second threshold compensation module and a second light emission control module.

The second threshold compensation module is connected to the initialization module and is configured to be initialized under the control of an initialization signal outputted from the initialization module. The second threshold compensation module is connected to the second driving module, and is configured to perform threshold voltage compensation on the second driving module. The second light emission module is connected to the second light emission control module, and is configured to emit light for display under the control of the second driving module and the second light emission control module.

In this way, the second pixel sub-circuit formed by the second driving module, the second light emission module, the second threshold compensation module and the second light emission control module is easy to be implemented in design of the pixel circuit.

Optionally, the second threshold compensation module comprises a second storage capacitor and a second transistor; the second driving module comprises a sixth transistor; the second light emission control module comprises a tenth transistor; and the second light emission module comprises a second light-emitting diode.

In this way, the second pixel sub-circuit formed by the storage capacitor, the transistors and the light-emitting diode is easy to be implemented in design of the pixel circuit.

Optionally, one terminal of the second storage capacitor is connected to the high voltage level signal line, and the other terminal thereof is connected to the gate of the sixth transistor. The gate of the second transistor is connected to a switching control signal line, the source of the second transistor is connected to the second storage capacitor, and the drain of the second transistor is connected to the initialization module and the source of the fourth transistor. The gate of the sixth transistor is connected to the initialization module and the source of the second transistor, the source of the sixth transistor is connected to the data voltage writing module and the drain of the seventh transistor, and the drain of the sixth transistor is connected to the second light-emitting diode. The gate of the tenth transistor is connected to the light emission control signal line, and the source of the tenth transistor is connected to the drain of the sixth transistor, and the drain of the tenth transistor is connected to the second light-emitting diode. The anode of the second light-emitting diode is connected to the drain of the tenth transistor, and the cathode of the second light-emitting diode is connected to the low voltage level signal line.

In this way, the connection relationship of the storage capacitor, the transistors and the light-emitting diode is easy to be implemented in design of the pixel circuit.

Optionally, the initialization module comprises a third transistor and an eight transistor. The gate of the third transistor is connected to a reset signal line, the source of the third transistor is connected to the source of the fourth transistor in the first threshold compensation module of the first pixel sub-circuit, and the drain of the third transistor is connected to the low voltage level signal line. The gate of the eighth transistor is connected to the reset signal line, the source of the eight transistor is connected to the source of the second transistor in the second threshold compensation module of the second pixel sub-circuit, and the drain of the eight transistor is connected to the low voltage level signal line.

In this way, the initialization module comprises the third transistor and the eight transistor, and the third and eighth transistors function as the switching devices of the initialization module in the pixel circuit and are easy to be implemented in the circuit design.

Optionally, the data voltage writing module comprises a first transistor, the gate of the first transistor is connected to a gate signal control line, the source of the first transistor is connected to a data signal line, and the drain of the first transistor is connected to the source of the fifth transistor in the first driving module of the first pixel sub-circuit and the source of the sixth transistor in the second driving module of the second pixel sub-circuit.

In this way, the data voltage writing module comprises the first transistor, and the first transistor functions as the switching device of the data voltage writing module in the pixel circuit and is easy to be implemented in the circuit design.

Optionally, data voltages inputted by the data voltage writing module comprise a first data voltage and a second data voltage, wherein the first data voltage is configured to drive the second threshold compensation module to perform threshold voltage compensation on the second driving module, and the second data voltage is configured to drive the first threshold compensation module to perform threshold voltage compensation on the first driving module.

In this way, since the data signal is a timing signal of a stepped shape, it is possible to realize two different voltage values inputted by one data signal line.

Optionally, each of the first light-emitting diode and the second light-emitting diode is an organic light-emitting diode.

In this way, the organic light-emitting diode is used as the light-emitting diodes of the first light emission module and the second light emission module in the pixel circuit, and it is easy to be implemented in the circuit design.

Optionally, all of the transistors are thin film transistors of P type.

In this way, the thin film transistors of P type are used as the thin film transistors in the pixel circuit, which is easy to be implemented in the circuit design.

The display provided in an embodiment of the present disclosure comprises a plurality of pixels, a plurality of data signal lines and a plurality of gate control signal lines, wherein every two pixels of the plurality of pixels constitute a pixel unit, and the display further comprises the pixel circuit described above which is connected to respective one of pixel units.

In this way, since the display comprises the pixel circuit described above which is connected to respective one of pixel units, the display possesses the advantage of the pixel circuit, and the display quality of the picture can be greatly improved.

Optionally, two pixels in each of the pixel units share one data signal line.

In this way, two pixels in each of the pixel units share one data signal line, thus one data signal line can be saved for the two pixels, and the arrangement of the data signal lines is simple.

Optionally, two pixels in each of the pixel units share one gate control signal line.

In this way, two pixels in each of the pixel units share one gate control signal line, thus one gate control signal line can be saved for the two pixels, and the arrangement of the gate control signal lines is simple.

DETAILED DESCRIPTION

In embodiments of the present disclosure, there are provided a pixel circuit and a display for reducing size of the pixel circuit, so as to further reduce a pixel pitch, increase the number of the pixels contained in per unit area and improve picture display quality.

Here, the pixel circuit provided by the embodiments of the present disclosure refers to an active matrix light emitting diode pixel circuit, and since the active matrix light emitting diode pixel circuit can play a role of performing compensation on a driving module of the pixel circuit, the active matrix light emitting diode pixel circuit of the present disclosure can also be referred to as active matrix light emitting diode pixel compensation circuit.

Hereinafter, detailed discussion will be given to technical solutions provided by the embodiments of the present disclosure.

Figure 1:
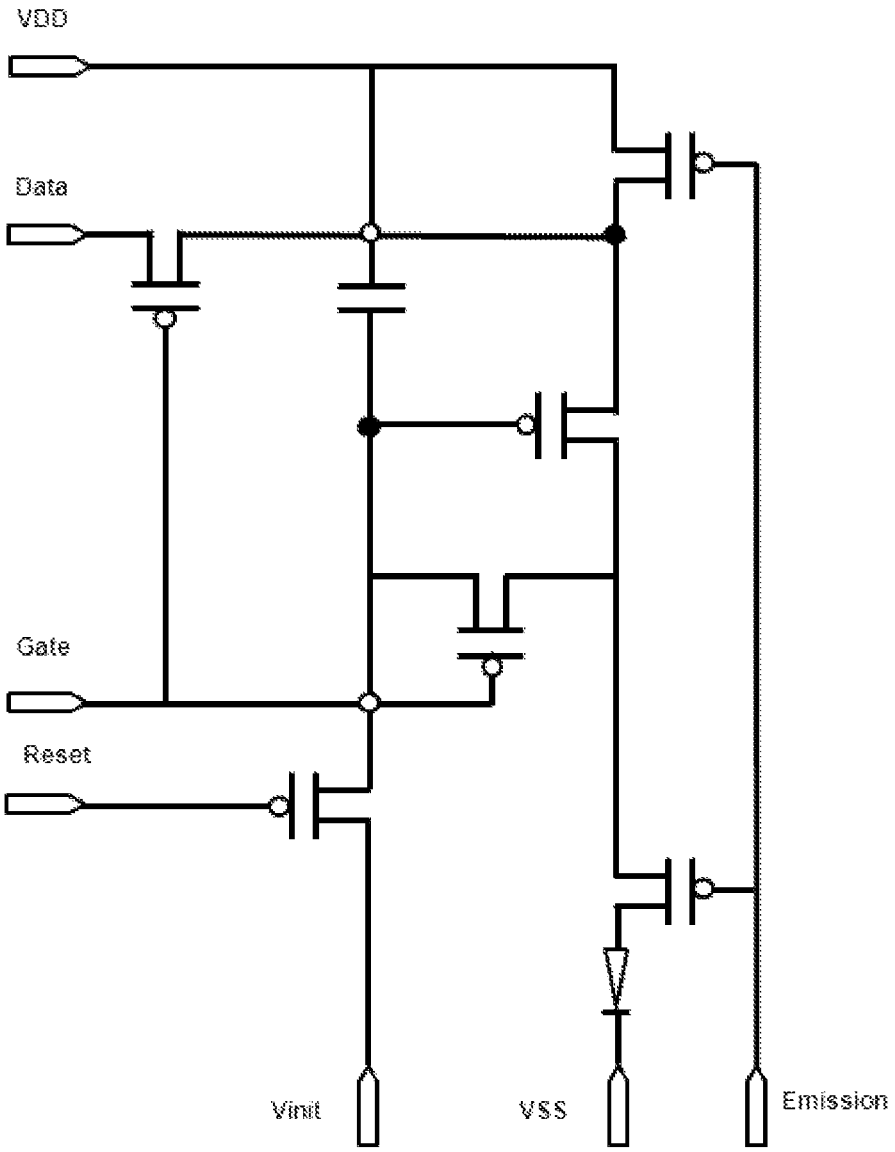
(Prior Art) Fig.1
FIG. 1 is a schematic diagram of a 6T1C AMOLED pixel compensation circuit of a single pixel in the prior art.
Figure 2:
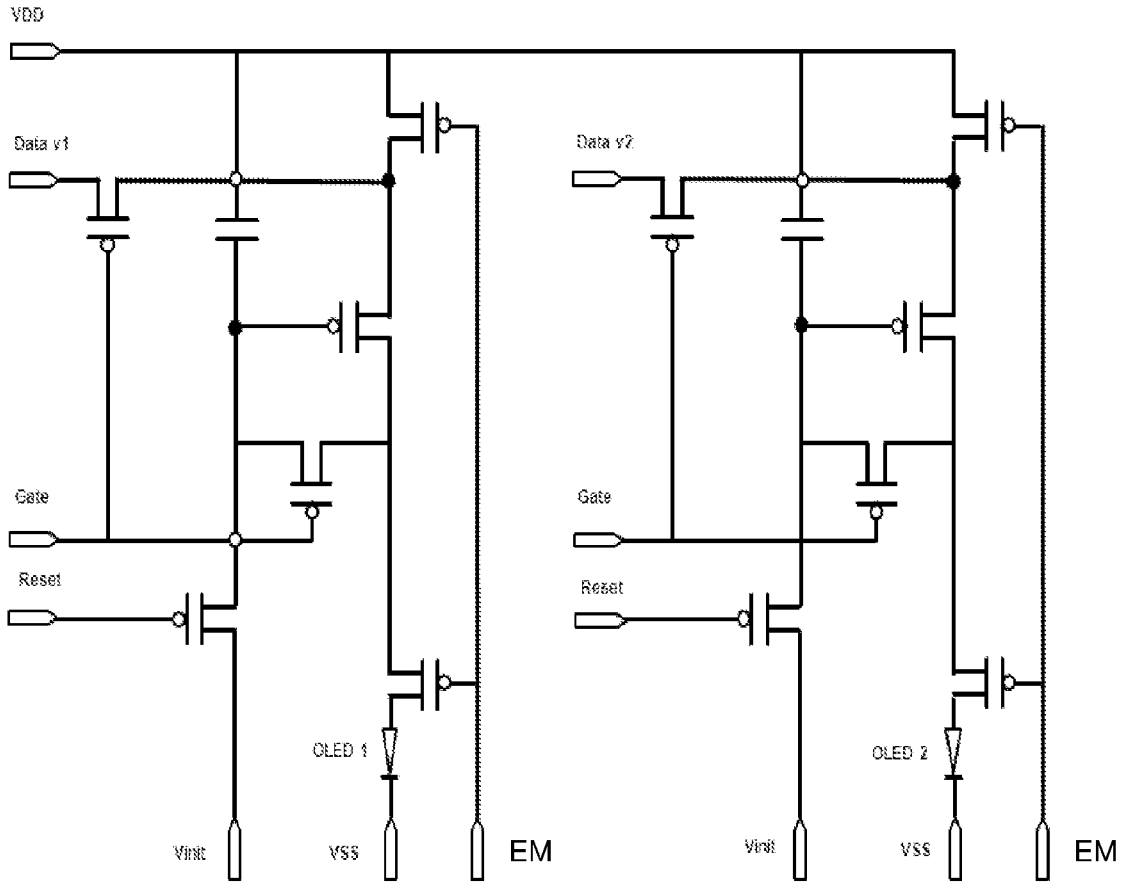
(Prior Art) Fig.2
FIG. 2 is a schematic diagram of a 12T2C AMOLED pixel compensation circuit of two pixels in the prior art.
Figure 3:
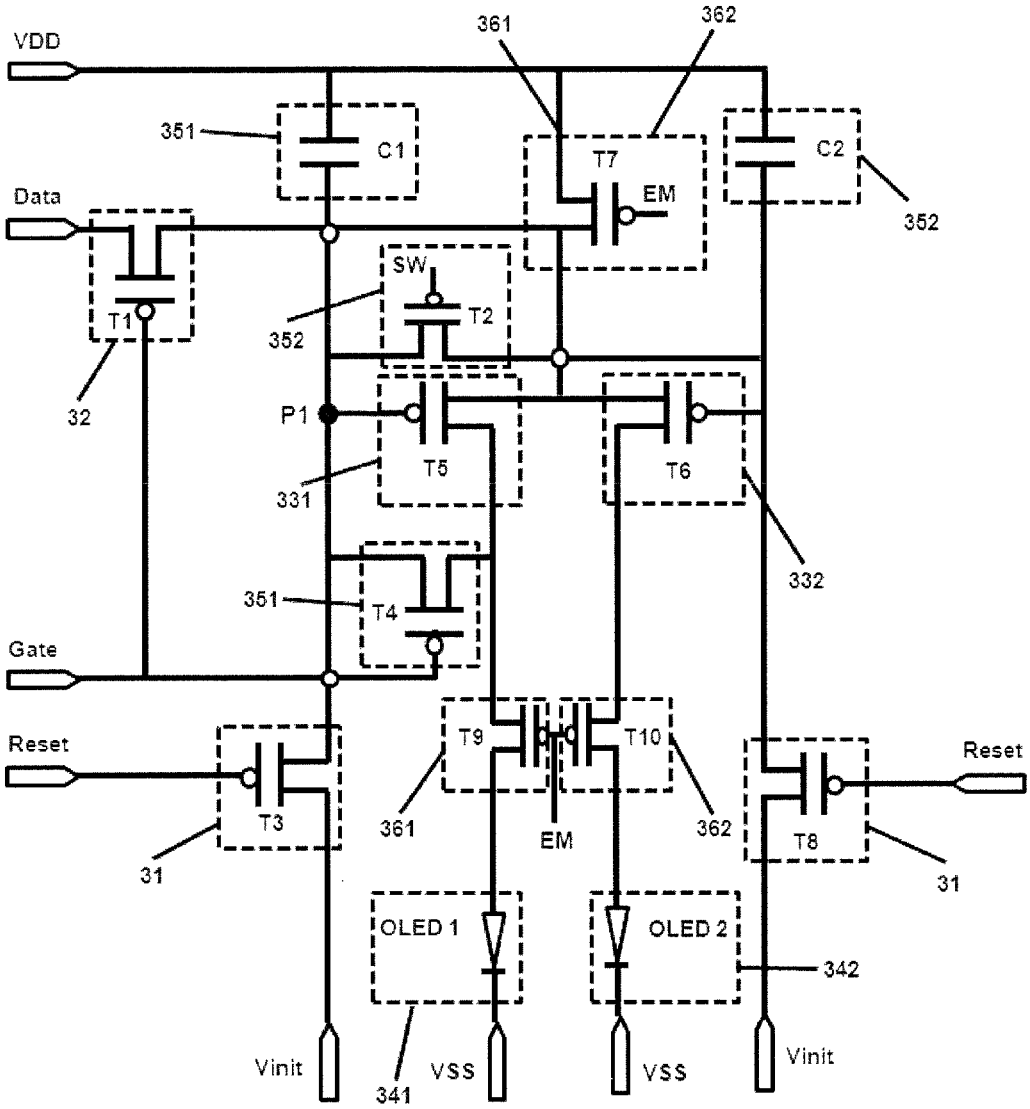
FIG. 3 is a schematic diagram of a 10T2C AMOLED pixel circuit provided by an embodiment of the present disclosure.

As shown in FIG. 3, an active matrix light emitting diode pixel compensation circuit provided in an embodiment of the present disclosure comprises a first pixel sub-circuit and a second pixel sub-circuit, as well as an initialization module 31 and a data voltage writing module 32 connected to the first pixel sub-circuit and the second pixel sub-circuit.

The initialization module 31 is connected to a reset signal terminal (corresponding to an initialization control signal Reset of the AMOLED pixel compensation circuit) and a low potential terminal (corresponding to an initialization voltage level signal Vinit of the AMOLED pixel compensation circuit), and is configured to initialize the first pixel sub-circuit and the second pixel sub-circuit under the control of a reset signal inputted from the reset signal terminal.

The data voltage writing module 32 is connected to a data voltage terminal (corresponding to a data signal Data of the AMOLED pixel circuit) and a gate signal terminal (corresponding to a gate control signal Gate of the AMOLED pixel circuit), and is configured to, under the control of a signal inputted from the gate signal terminal, firstly write a first data voltage to the first pixel sub-circuit and the second pixel sub-circuit and perform a compensation on a driving module of the second pixel sub-circuit, and then to write a second data voltage to the first pixel sub-circuit and perform a compensation on a driving module of the first pixel sub-circuit.

In the circuit shown in FIG. 3, in order to distinguish cross connection and cross disconnection between wires, the connected cross point is represented with a solid dot, and the disconnected cross point is represented with a hollow dot.

Optionally, the first pixel sub-circuit comprises a first driving module 331, a first light emission module 341, a first threshold compensation module 351 and a first light emission control module 361.

The first threshold compensation module 351 is connected to the initialization module 31 and is initialized under the control of an initialization signal outputted from the initialization module 31. The first threshold compensation module 351 is connected to the first driving module 331, and is configured to perform threshold voltage compensation on the first driving module 331. The first light emission module 341 is connected to the first light emission control module 361, and is configured to emit light for display under the control of the first driving module 331 and the first light emission control module 361.

Optionally, the first threshold compensation module 351 comprises a first storage capacitor C1 and a fourth transistor T4. The first driving module 331 comprises a fifth transistor T5; the first light emission control module 361 comprises a seventh transistor T7 and a ninth transistor T9; and the first light emission module 341 comprises a first light-emitting diode OLED1.

Optionally, one terminal of the first storage capacitor C1 is connected to a high voltage level signal line (corresponding to a high voltage level signal VDD), and the other terminal thereof is connected to the source of the fourth transistor T4.

The gate of the fourth transistor T4 is connected to the gate signal terminal (corresponding to the gate control signal Gate of the AMOLED pixel circuit), the source of the fourth transistor T4 is connected to the initialization module 31, and the drain of the fourth transistor T4 is connected to the drain of the fifth transistor T5.

The gate of the fifth transistor T5 is connected to the source of the fourth transistor T4, and the source of the fifth transistor T5 is connected to the data voltage writing module 32.

The gate of the seventh transistor T7 is connected to a light emission control signal line (corresponding to a light emission control signal EM of the AMOLED pixel circuit), the source of the seventh transistor T7 is connected to the high voltage level signal line (corresponding to the high voltage level signal VDD), and the drain of the seventh transistor T7 is connected to the source of the fifth transistor T5.

The gate of the ninth transistor T9 is connected to the light emission control signal line (corresponding to the light emission control signal EM of the AMOLED pixel circuit), the source of the ninth transistor T9 is connected to the drain of the fifth transistor T5, and the drain of the ninth transistor T9 is connected to the first light-emitting diode OLED1.

The anode of the first light-emitting diode OLED1 is connected to the drain of the ninth transistor T9, and the cathode of the first light-emitting diode OLED1 is connected to a low voltage level signal line (corresponding to a low voltage level signal VSS).

Optionally, the second pixel sub-circuit comprises a second driving module 332, a second light emission module 342, a second threshold compensation module 352 and a second light emission control module 362.

The second threshold compensation module 352 is connected to the initialization module 31 and is initialized under the control of an initialization signal outputted from the initialization module 31.

The second threshold compensation module 352 is connected to the second driving module 332, and is configured to perform threshold voltage compensation on the second driving module 332.

The second light emission module 342 is connected to the second light emission control module 362, and is configured to emit light for display under the control of the second driving module 332 and the second light emission control module 362.

Optionally, the second threshold compensation module 352 comprises a second storage capacitor C2 and a second transistor T2. The second driving module 332 comprises a sixth transistor T6; the second light emission control module 362 comprises a tenth transistor T10; and the second light emission module 342 comprises a second light-emitting diode OLED2.

Optionally, one terminal of the second storage capacitor C2 is connected to the high voltage level signal line (corresponding to the high voltage level signal VDD), and the other terminal thereof is connected to the gate of the sixth transistor T6.

The gate of the second transistor T2 is connected to a switching control signal line (corresponding to a switching control signal SW of the AMOLED pixel circuit), the source of the second transistor T2 is connected to the second storage capacitor C2, and the drain of the second transistor T2 is connected to the initialization module 31.

The gate of the sixth transistor T6 is connected to the initialization module 31, the source of the sixth transistor T6 is connected to the data voltage writing module 32 and the drain of the seventh transistor T7, and the drain of the sixth transistor T6 is connected to the second light-emitting diode OLED2.

The gate of the tenth transistor T10 is connected to the light emission control signal line (corresponding to the light emission control signal EM of the AMOLED pixel circuit), and the source of the tenth transistor T10 is connected to the drain of the sixth transistor T6, and the drain of the tenth transistor T10 is connected to the second light-emitting diode OLED2.

The anode of the second light-emitting diode OLED2 is connected to the drain of the tenth transistor T10, and the cathode of the second light-emitting diode OLED2 is connected to the low voltage level signal line (corresponding to the low voltage level signal VSS).

Here, the light emitting control modules 361 and 362 can control the light emission of the OLED 1 and the OLED 2 simultaneously or separately.

Optionally, the initialization module 31 comprises a third transistor T3 and an eight transistor T8.

The gate of the third transistor T3 is connected to a reset signal line (corresponding to the initialization control signal Reset of the AMOLED pixel circuit), the source of the third transistor T3 is connected to the first threshold compensation module 351 of the first pixel sub-circuit, and the drain of the third transistor T3 is connected to the low voltage level signal line (corresponding to the initialization voltage level signal Vinit of the AMOLED pixel circuit).

The gate of the eighth transistor T8 is connected to the reset signal line (corresponding to the initialization control signal Reset of the AMOLED pixel circuit), the source of the eight transistor T8 is connected to the second threshold compensation module 352 of the second pixel sub-circuit, and the drain of the eight transistor T8 is connected to the low voltage level signal line (corresponding to the initialization voltage level signal Vinit of the AMOLED pixel circuit).

Optionally, the data voltage writing module 32 comprises a first transistor T1. The gate of the first transistor T1 is connected to a gate signal control line (corresponding to the gate control signal Gate of the AMOLED pixel circuit), the source of the first transistor T1 is connected to a data signal line (corresponding to the data signal Data of the AMOLED pixel circuit), and the drain of the first transistor T1 is connected to the first driving module 331 of the first pixel sub-circuit and the second driving module 332 of the second pixel sub-circuit.

Optionally, data voltages inputted by the data voltage writing module 32 comprise a first data voltage and a second data voltage, the first data voltage is configured to drive the second threshold compensation module 352 to perform threshold voltage compensation on the second driving module 332, and the second data voltage is configured to drive the first threshold compensation module 351 to perform threshold voltage compensation on the first driving module 331.

Optionally, each of the first light-emitting diode OLED1 and the second light-emitting diode OLED2 is an organic light-emitting diode.

Optionally, each of the transistors T1, T2, T3, T4, T5, T6, T7, T8, T9, and T10 is a thin film transistor of P type.

Hereinafter, the operational principle of the AMOLED pixel compensation circuit provided by the embodiment of the present disclosure will be explained in detail with reference to FIGS. 3-8.

Figure 4:
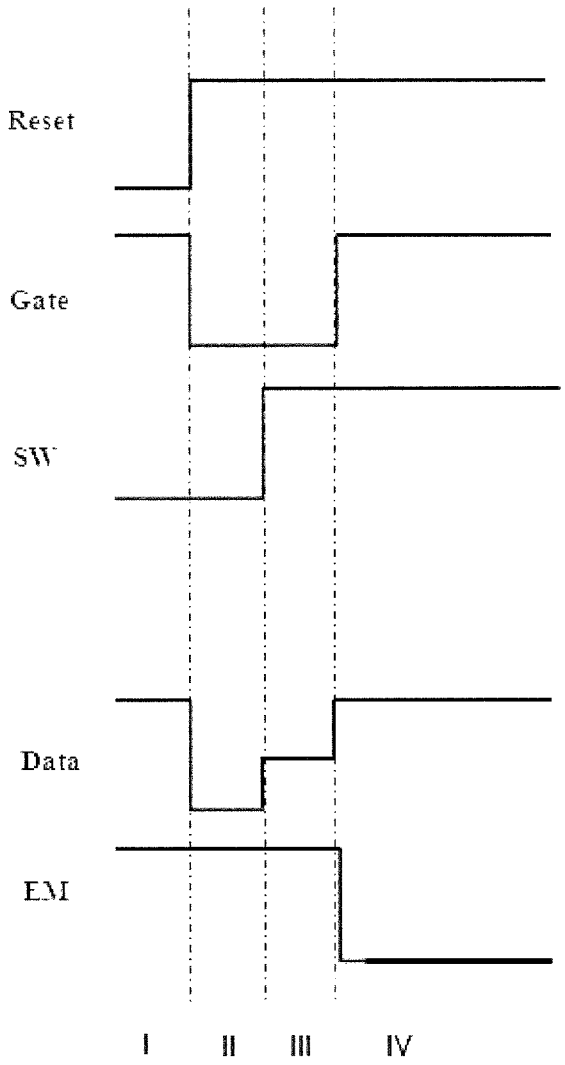
FIG. 4 is a timing chart for operation of the 10T2C AMOLED pixel circuit provided by the embodiment of the present disclosure.
Figure 5:
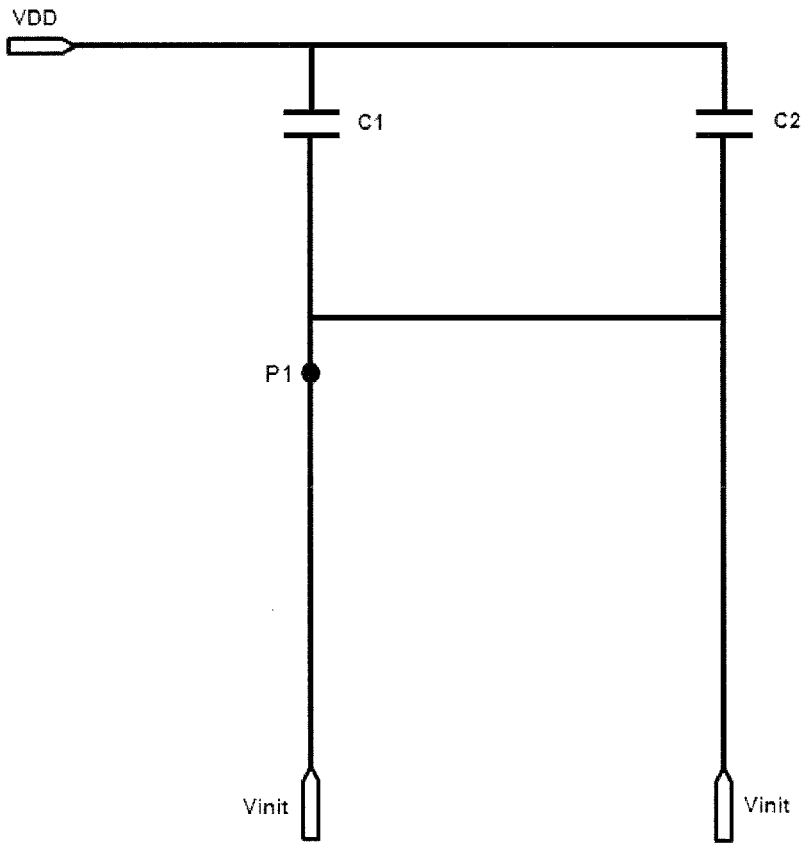
FIG. 5 is a simplified circuit diagram of the 10T2C AMOLED pixel circuit provided by the embodiment of the present disclosure in initialization operation phase.

As shown in FIG. 4, during phase I, the gate control signal Gate and the light emission control signal EM are at a high level; the initialization control signal Reset and the switching control signal SW are at a low level. At this timing, the third transistor T3, the second transistor T2 and the eighth transistor T8 in FIG. 3 are turned on; and the first transistor T1, the fourth transistor T4, the seventh transistor T7, the ninth transistor T9 and the tenth transistor T10 are turned off. Therefore, the simplified circuit diagram of FIG. 3 is as shown in FIG. 5. Since storage capacitors C1 and C2 store the data signal Data inputted from a previous frame picture respectively, both of the two capacitors are connected to the initialization voltage level signal Vinit with a low potential, such that each of the storage capacitors C1 and C2 is discharged by the initialization voltage level signal Vinit so as to be discharged to the initialization voltage Vinit.

Figure 6:
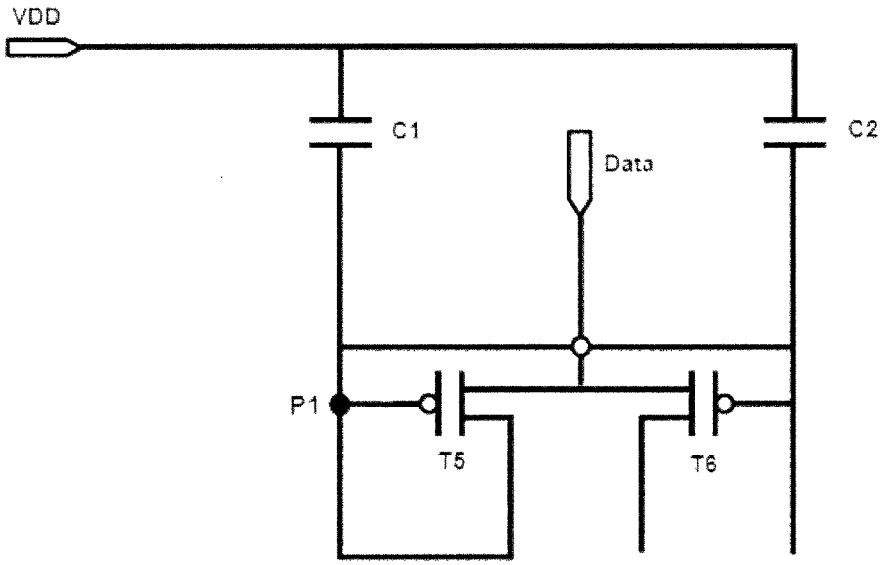
FIG. 6 is a simplified circuit diagram of the 10T2C AMOLED pixel circuit provided by the embodiment of the present disclosure in a first threshold compensation phase.

As shown in FIG. 4, during phase II, the initialization control signal Reset and the light emission control signal EM are at the high level; the gate control signal Gate and the switching control signal SW are at the low level. At this timing, the first transistor T1, the second transistor T2 and the fourth transistor T4 in FIG. 3 are turned on; and the third transistor T3, the eighth transistor T8, the seventh transistor T7, the ninth transistor T9 and the tenth transistor T10 are turned off. Therefore, the simplified circuit diagram of FIG. 3 is as shown in FIG. 6. The data level signal Data inputs a first voltage value V1, and at this timing, the fifth transistor T5 is equivalent to a diode since the fourth transistor T4 is turned on, thus the voltage at a first node P1 becomes a value of V=V1−Vth(T5), where Vth(T5) is the threshold voltage of the fifth transistor T5, and the voltage value V is stored in the first storage capacitor C1 and the second storage capacitor C2.

Figure 7:
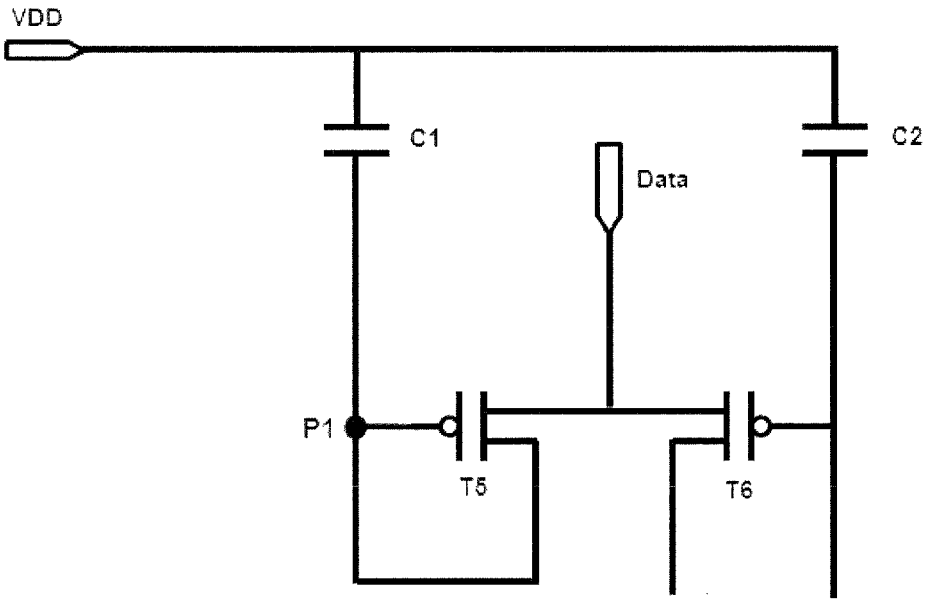
FIG. 7 is a simplified circuit diagram of the 10T2C AMOLED pixel circuit provided by the embodiment of the present disclosure in a second threshold compensation phase.

As shown in FIG. 4, during phase III, the initialization control signal Reset, the switching control signal SW and the light emission control signal EM are at the high level; the gate control signal Gate is at the low level. At this timing, the first transistor T1 and the fourth transistor T4 in FIG. 3 are turned on; and the second transistor T2, the third transistor T3, the eighth transistor T8, the seventh transistor T7, the ninth transistor T9 and the tenth transistor T10 are turned off. Therefore, the simplified circuit diagram of FIG. 3 is as shown in FIG. 7. The data level signal Data inputs a second voltage value V2, and at this timing, the fifth transistor T5 is equivalent to a diode since the fourth transistor T4 is turned on, thus the voltage at the first node P1 becomes a value of V'=V2−Vth(T5), where Vth(T5) is the threshold voltage of the fifth transistor T5, and the voltage value V' is stored in the first storage capacitor C1.

Figure 8:
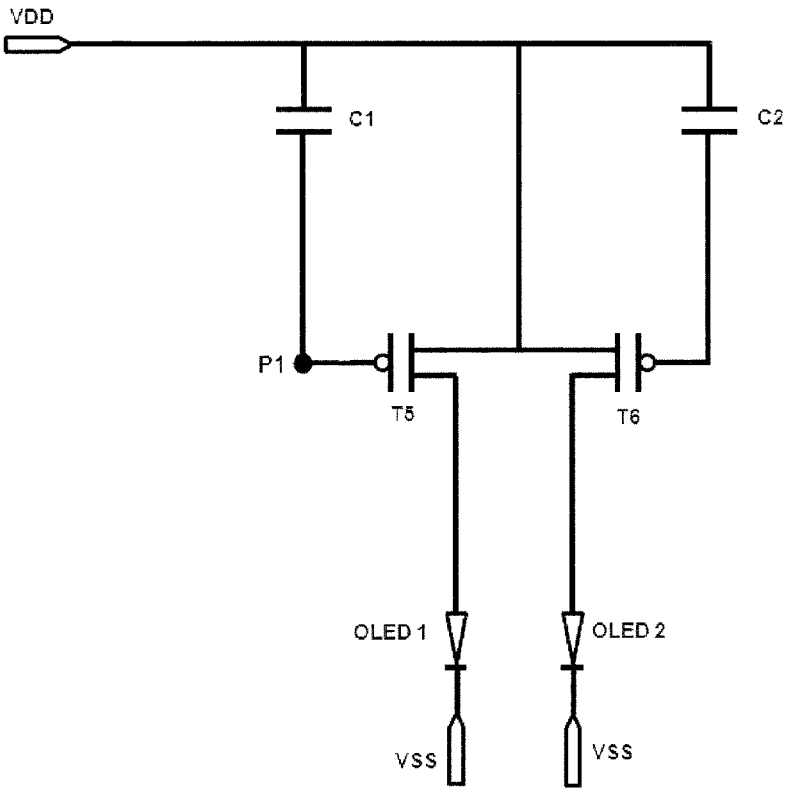
FIG. 8 is a simplified circuit diagram of the 10T2C AMOLED pixel circuit provided by the embodiment of the present disclosure in a light emission phase.

As shown in FIG. 4, in phase IV which is the light emission phase, the initialization control signal Reset, the switching control signal SW and the gate control signal Gate are at the high level; the light emission control signal EM is at the low level. At this timing, the seventh transistor T7, the ninth transistor T9 and the tenth transistor T10 in FIG. 3 are turned on; and the first transistor T1, the second transistor T2, the third transistor T3, the fourth transistor T4 and the eighth transistor T8 are turned off. Therefore, the simplified circuit diagram of FIG. 3 is as shown in FIG. 8. Each of the fifth transistor T5 and the sixth transistor T6 is a driving transistor of OLED, and controls the current in such a way that the sources of the fifth transistor T5 and the sixth transistor T6 are connected to the high voltage level signal VDD, wherein the current flowing through the first light-emitting diode OLED1 is expressed by:

$$Id1 = \frac{k}{2} * [VDD - (V2 - Vth(T5)) - Vth(T5)]^2 = \frac{k}{2} * (VDD - V2)^2,$$

where, k is a preset constant, the current flowing through the second light-emitting diode OLED2 is expressed by $$Id2 = \frac{k}{2} * [VDD - (V1 - Vth(T5)) - Vth(T6)]^2 = \frac{k}{2} * [VDD - V1 + Vth(T5) - Vth(T6)]^2$$

where Vth(T6) is the threshold voltage of the sixth transistor T6. In design, the parameters of the fifth transistor T5 and the sixth transistor 6 are identical, and the fifth transistor T5 and the sixth transistor T6 are arranged closely in location; approximately Vth(T5)=Vth(T6), and thus $$Id2 = \frac{k}{2} * (VDD - V1)^2.$$

As can be seen from the above equations, the current Id1 flowing through the first light-emitting diode OLED1 and the current Id2 flowing through the second light-emitting diode OLED2 are independent of the threshold voltage Vth (T5) of the fifth transistor T5 and threshold voltage Vth (T6) of the sixth transistor T6, and therefore the compensation function is achieved.

In summary, the AMOLED pixel circuit provided by the embodiments of the present disclosure comprises ten thin film transistors and two capacitors, that is, 10T2C AMOLED pixel circuit.

The display provided by an embodiment of the present disclosure comprises a plurality of pixels, a plurality of data signal lines and a plurality of gate control signal lines, wherein every two pixels constitute a pixel unit, and the display further comprises the 10T2C AMOLED pixel circuit provided by the embodiments of the present disclosure which is connected to respective one of pixel units.

Hereinafter, an arrangement of the pixel unit comprising two pixels will be described in detail.

Figure 9:
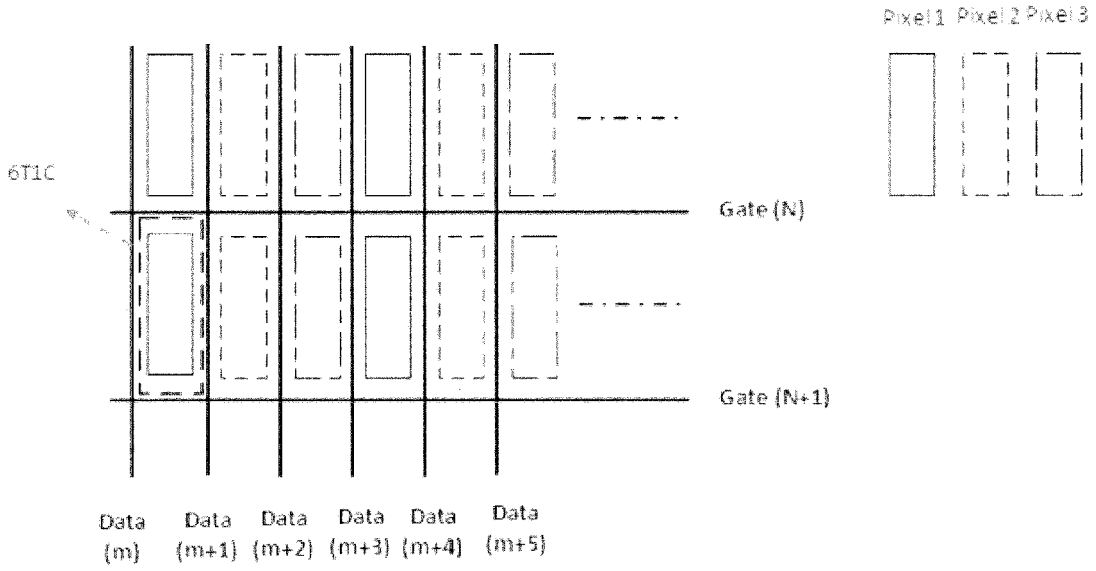
FIG. 9 is a schematic diagram of arrangement of a single pixel in the prior art.

The pixel arrangement of a single pixel in the prior art is shown in FIG. 9, and the compensation circuit in the single pixel is the 6T1C AMOLED pixel compensation circuit in the prior art. If two pixels are placed together to form one pixel unit, the compensation circuit of the pixel unit in the prior art is the 12T2C AMOLED pixel compensation circuit.

Figure 10:
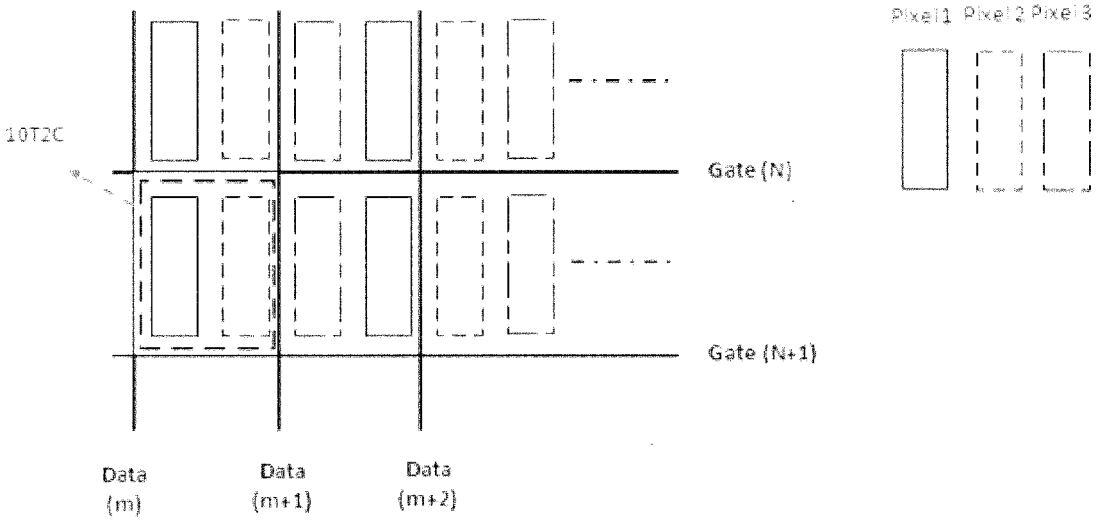
FIG. 10 is a schematic diagram of an arrangement of a pixel unit formed by two pixels in a horizontal direction provided by the embodiment of the present disclosure.
Figure 11:
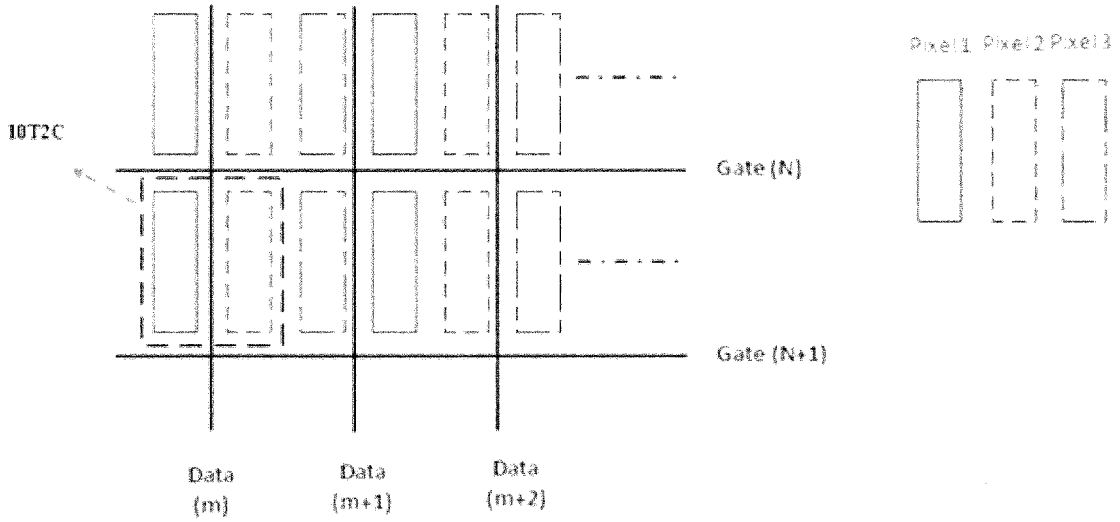
FIG. 11 is a schematic diagram of another arrangement of a pixel unit formed by two pixels in a horizontal direction provided by the embodiment of the present disclosure.
Figure 12:
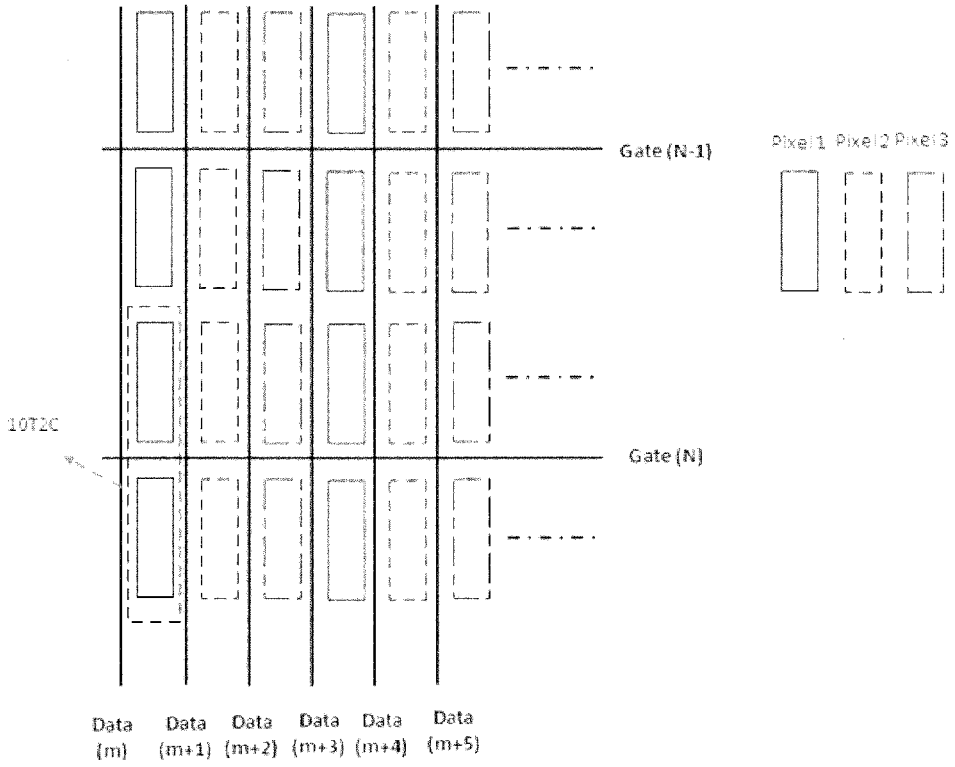
FIG. 12 is a schematic diagram of an arrangement of a pixel unit formed by two pixels in a vertical direction provided by the embodiment of the present disclosure.
Figure 13:
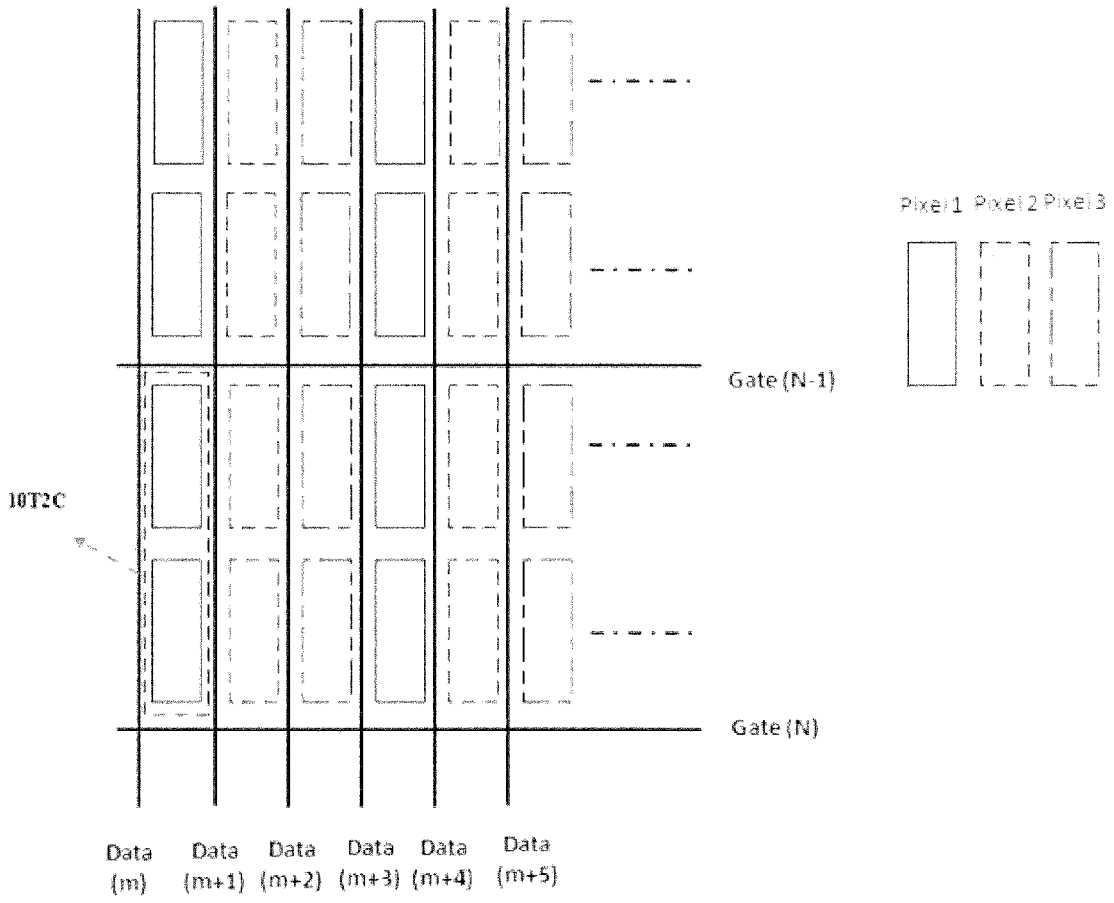
FIG. 13 is a schematic diagram of another arrangement of a pixel unit formed by two pixels in a vertical direction provided by the embodiment of the present disclosure.

The arrangement of the pixel unit comprising two pixels provided by the embodiments of the present disclosure is shown in FIGS. 10-13. As shown in FIGS. 10 and 11, two pixels in any of the pixel units arranged in a horizontal direction share one data signal line Data(m). As shown in FIGS. 12 and 13, two pixels in any of the pixel units arranged in a vertical direction share one gate control signal line Gate (N). Two pixels in any of the pixel units arranged in the horizontal direction are any two pixels in the horizontal direction such as Pixel 1 and Pixel 2, or Pixel 2 and Pixel 3, and two pixels in any of the pixel units arranged in the vertical direction are any two pixels in the vertical direction.

As shown in FIGS. 10 and 11, two pixels in any of the pixel units arranged in the horizontal direction share one data signal line Data (m), the data signal line Data (m) can be disposed between the two pixels Pixel 1 and Pixel 2 arranged in the horizontal direction (as shown in FIG. 11), or the data signal line Data (m) can be disposed at an external side of Pixel 1 of the two pixels Pixel 1 and Pixel 2 arranged in the horizontal direction (as shown in FIG. 10). The internal side refers to the side where the two pixels in any of the pixel units arranged in the horizontal direction are close to each other, and the external side refers to the side where the two pixels are far from each other. Of course, in the embodiments of the present disclosure, the data signal line Data (m) is not limited to be disposed at an external side of the Pixel 1, and can be disposed at an external side of any one of the two pixels arranged in the horizontal direction.

As shown in FIGS. 12 and 13, two pixels in any of the pixel units arranged in the vertical direction share one gate control signal line Gate (N), the gate control signal line Gate (N) can be disposed between any two of the pixels forming a pixel unit which are arranged in the vertical direction (as shown in FIG. 12), or the gate control signal line Gate (N) can be disposed at an external side of any one of any two pixels forming a pixel unit which are arranged in the vertical direction (as shown in FIG. 13).

In summary, in the technical solution provided by the embodiments of the present disclosure, the AMOLED pixel circuit comprises the first pixel sub-circuit and the second pixel sub-circuit, as well as the initialization module and the data voltage writing module connected to the first pixel sub-circuit and the second pixel sub-circuit; the initialization module is connected to the reset signal terminal and the low potential terminal, and serves to initialize the first pixel sub-circuit and the second pixel sub-circuit under the control of the reset signal inputted from the reset signal terminal; the data voltage writing module is connected to the data voltage terminal and the gate signal terminal, and serves to, under the control of the signal inputted from the gate signal terminal, firstly write the first data voltage to the first pixel sub-circuit and the second pixel sub-circuit, and then to write a second data voltage to the second pixel sub-circuit; the first pixel sub-circuit serves to perform compensation on the driving module of the first pixel, and the second pixel sub-circuit serves to perform compensation on the driving module of the second pixel. The AMOLED pixel circuit can reduce the size of pixel compensation circuit, so as to further reduce pixel pitch, increase the number of pixels contained in per unit area and improve picture display quality.

Obviously, those skilled in the art can make various changes or variations to the embodiments of the present disclosure without departing from the spirit and scope of the present invention. In this way, as long as those modifications and variations to the embodiments of the present disclosure are within the scope of the claims of the present invention and the equivalence thereof, the present invention is also intended to cover these changes and variation.

What is claimed is:

1. A pixel circuit comprising:

a first pixel sub-circuit and a second pixel sub-circuit different from the first pixel sub-circuit, as well as an initialization module and a data voltage writing module connected to the first pixel sub-circuit and the second pixel sub-circuit, wherein the initialization module is connected to a reset signal terminal and a low potential terminal, and is configured to initialize the first pixel sub-circuit and the second pixel sub-circuit under the control of a reset signal inputted from the reset signal terminal;

the data voltage writing module is connected to a data voltage terminal and a gate signal terminal, and is configured to, under the control of a signal inputted from the gate signal terminal, firstly write a first data voltage to the first pixel sub-circuit and the second pixel sub-circuit and then to write a second data voltage to the first pixel sub-circuit;

wherein after the first data voltage is written to the first pixel sub-circuit and the second pixel sub-circuit, the second pixel sub-circuit performs compensation on a driving module of the second pixel sub-circuit;

the data voltage writing module writes the second data voltage to the first pixel sub-circuit only after the compensation on the driving module of the second pixel sub-circuit is performed;

after the second data voltage is written to the first pixel sub-circuit, the first pixel sub-circuit performs compensation on a driving module of the first pixel sub-circuit;

wherein after the first data voltage is written into the first pixel sub-circuit and the second data voltage is written into the second pixel sub-circuit, the first pixel sub-circuit and the second pixel sub-circuit emit light concurrently.

2. The pixel circuit according to claim 1, wherein the first pixel sub-circuit comprises a first driving module, a first light emission module, a first threshold compensation module and a first light emission control module, wherein the first threshold compensation module is connected to the initialization module and is configured to be initialized under the control of an initialization signal outputted from the initialization module;

the first threshold compensation module is connected to the first driving module, and is configured to perform threshold voltage compensation on the first driving module; and the first light emission module is connected to the first light emission control module, and is configured to emit light for display under the control of the first driving module and the first light emission control module.

3. The pixel circuit according to claim 2, wherein the first threshold compensation module comprises a first storage capacitor and a first compensation transistor (T4); the first driving module comprises a first driving transistor (T5); the first light emission control module comprises a common control transistor (T7) and a first control transistor (T9); and the first light emission module comprises a first light-emitting diode.

4. The pixel circuit according to claim 3, wherein one terminal of the first storage capacitor is connected to a high voltage level signal line, and the other terminal thereof is connected to a source of the first compensation transistor (T4);

a gate of the first compensation transistor (T4) is connected to the gate signal terminal, the source of the first compensation transistor (T4) is connected to the initialization module, and a drain of the first compensation transistor (T4) is connected to a drain of the first driving transistor (T5);

a gate of the first driving transistor (T5) is connected to the source of the first compensation transistor (T4), and a source of the first driving transistor (T5) is connected to the data voltage writing module;

a gate of the common control transistor (T7) is connected to a light emission control signal line, a source of the common control transistor (T7) is connected to the high voltage level signal line, a drain of the common control transistor (T7) is connected to the source of the first driving transistor (T5);

a gate of the first control transistor (T9) is connected to the light emission control signal line, a source of the first control transistor (T9) is connected to the drain of the first driving transistor (T5), and a drain of the first control transistor (T9) is connected to the first light-emitting diode;

an anode of the first light-emitting diode is connected to the drain of the first control transistor (T9), and a cathode of the first light-emitting diode is connected to a low voltage level signal line.

5. The pixel circuit according to claim 4, wherein the second pixel sub-circuit comprises a second driving module, a second light emission module, a second threshold compensation module and a second light emission control module, wherein the second threshold compensation module is connected to the initialization module and is configured to be initialized under the control of an initialization signal outputted from the initialization module;

the second threshold compensation module is connected to the second driving module, and is configured to perform threshold voltage compensation on the second driving module; and the second light emission module is connected to the second light emission control module, and is configured to emit light for display under the control of the second driving module and the second light emission control module.

6. The pixel circuit according to claim 5, wherein the second threshold compensation module comprises a second storage capacitor and a second compensation transistor (T2); the second driving module comprises a second driving transistor (T6); the second light emission control module comprises a second control transistor (T10); and the second light emission module comprises a second light-emitting diode.

7. The pixel circuit according to claim 6, wherein one terminal of the second storage capacitor is connected to the high voltage level signal line, and the other terminal thereof is connected to a gate of the second driving transistor (T6);

a gate of the second compensation transistor (T2) is connected to a switching control signal line, a source of the second compensation transistor (T2) is connected to the second storage capacitor, and a drain of the second compensation transistor (T2) is connected to the initialization module and the source of the first compensation transistor (T4);

the gate of the second driving transistor (T6) is connected to the initialization module and the source of the second compensation transistor (T2), a source of the second driving transistor (T6) is connected to the data voltage writing module and the drain of the common control transistor (T7), and a drain of the second driving transistor (T6) is connected to the second light-emitting diode;

a gate of the second control transistor (T10) is connected to the light emission control signal line, and a source of the second control transistor (T10) is connected to the drain of the second driving transistor (T6), and a drain of the second control transistor (T10) is connected to the second light-emitting diode;

an anode of the second light-emitting diode is connected to the drain of the second control transistor (T10), and a cathode of the second light-emitting diode is connected to the low voltage level signal line.

8. The pixel circuit according to claim 7, wherein the initialization module comprises a first reset transistor (T3) and a eighth second reset transistor (T8), wherein a gate of the first reset transistor (T3) is connected to a reset signal line, a source of the first reset transistor (T3) is connected to the source of the first compensation transistor (T4) in the first threshold compensation module of the first pixel sub-circuit, and a drain of the first reset transistor (T3) is connected to the low voltage level signal line;

a gate of the second reset transistor (T8) is connected to the reset signal line, a source of the second reset transistor (T8) is connected to the source of the second compensation transistor (T2) in the second threshold compensation module of the second pixel sub-circuit, and a drain of the second reset transistor (T8) is connected to the low voltage level signal line.

9. The pixel circuit according to claim 8, wherein the data voltage writing module comprises a data voltage writing transistor (T1), wherein a gate of the data voltage writing transistor (T1) is connected to a gate signal control line, a source of the data voltage writing transistor (T1) is connected to a data signal line, and a drain of the data voltage writing transistor (T1) is connected to the source of the first driving transistor (T5) in the first driving module of the first pixel sub-circuit and the source of the second driving transistor (T6) in the second driving module of the second pixel sub-circuit.

10. The pixel circuit according to claim 9, wherein both the first light-emitting diode and the second light-emitting diode are organic light-emitting diodes.

11. The pixel circuit according to claim 10, wherein all of the transistors are thin film transistors of P type.

12. A display comprising a plurality of pixels, a plurality of data signal lines and a plurality of gate control signal lines, wherein every two pixels in the plurality of pixels constitute a pixel unit, and the display further comprises the pixel circuit according to claim 1 which is connected to respective one of pixel units.

13. The display according to claim 12, wherein every two pixels arranged in a horizontal direction forms a pixel unit, and the two pixels in each of pixel units share one data signal line;

or every two pixels arranged in a vertical direction forms a pixel unit, and the two pixels in each of pixel units share one gate control signal line.

14. The display according to claim 13, wherein the first pixel sub-circuit comprises a first driving module, a first light emission module, a first threshold compensation module and a first light emission control module, wherein the first threshold compensation module is connected to the initialization module and is configured to be initialized under the control of an initialization signal outputted from the initialization module;

the first threshold compensation module is connected to the first driving module, and is configured to perform threshold voltage compensation on the first driving module; and the first light emission module is connected to the first light emission control module, and is configured to emit light for display under the control of the first driving module and the first light emission control module.

15. The display according to claim 14, wherein the first threshold compensation module comprises a first storage capacitor and a first compensation transistor (T4); the first driving module comprises a first driving transistor (T5); the first light emission control module comprises a common control transistor (T7) and a first control transistor (T9); and the first light emission module comprises a first light-emitting diode, one terminal of the first storage capacitor is connected to a high voltage level signal line, and the other terminal thereof is connected to a source of the first compensation transistor (T4);

a gate of the first compensation transistor (T4) is connected to the gate signal terminal, the source of the first compensation transistor (T4) is connected to the initialization module, and a drain of the first compensation transistor (T4) is connected to a drain of the first driving transistor (T5);

a gate of the first driving transistor (T5) is connected to the source of the first compensation transistor (T4), and a source of the first driving transistor (T5) is connected to the data voltage writing module;

a gate of the common control transistor (T7) is connected to a light emission control signal line, a source of the common control transistor (T7) is connected to the high voltage level signal line, a drain of the common control transistor (T7) is connected to the source of the first driving transistor (T5);

a gate of the first control transistor (T9) is connected to the light emission control signal line, a source of the first control transistor (T9) is connected to the drain of the first driving transistor (T5), and a drain of the first control transistor (T9) is connected to the first light-emitting diode;

an anode of the first light-emitting diode is connected to the drain of the first control transistor (T9), and a cathode of the first light-emitting diode is connected to a low voltage level signal line.

16. The display according to claim 15, wherein the second pixel sub-circuit comprises a second driving module, a second light emission module, a second threshold compensation module and a second light emission control module, wherein the second threshold compensation module is connected to the initialization module and is configured to be initialized under the control of an initialization signal outputted from the initialization module;

the second threshold compensation module is connected to the second driving module, and is configured to perform threshold voltage compensation on the second driving module; and the second light emission module is connected to the second light emission control module, and is configured to emit light for display under the control of the second driving module and the second light emission control module.

17. The display according to claim 16, wherein the second threshold compensation module comprises a second storage capacitor and a second compensation transistor (T2); the second driving module comprises a second driving transistor (T6); the second light emission control module comprises a second control transistor (T10); and the second light emission module comprises a second light-emitting diode, one terminal of the second storage capacitor is connected to the high voltage level signal line, and the other terminal thereof is connected to a gate of the second driving transistor (T6);

a gate of the second compensation transistor (T2) is connected to a switching control signal line, a source of the second compensation transistor (T2) is connected to the second storage capacitor, and a drain of the second compensation transistor (T2) is connected to the initialization module and the source of the first compensation transistor (T4);

the gate of the second driving transistor (T6) is connected to the initialization module and the source of the second compensation transistor (T2), a source of the second driving transistor (T6) is connected to the data voltage writing module and the drain of the common control transistor (T7), and a drain of the second driving transistor (T6) is connected to the second light-emitting diode;

a gate of the second control transistor (T10) is connected to the light emission control signal line, and a source of the second control transistor (T10) is connected to the drain of the second driving transistor (T6), and a drain of the second control transistor (T10) is connected to the second light-emitting diode;

an anode of the second light-emitting diode is connected to the drain of the second control transistor (T10), and a cathode of the second light-emitting diode is connected to the low voltage level signal line.

18. The display according to claim 17, wherein the initialization module comprises a first reset transistor (T3) and a second reset transistor (T8), wherein a gate of the first reset transistor (T3) is connected to a reset signal line, a source of the first reset transistor (T3) is connected to the source of the first compensation transistor (T4) in the first threshold compensation module of the first pixel sub-circuit, and a drain of the first reset transistor (T3) is connected to the low voltage level signal line;

a gate of the second reset transistor (T8) is connected to the reset signal line, a source of the second reset transistor (T8) is connected to the source of the second compensation transistor (T2) in the second threshold compensation module of the second pixel sub-circuit, and a drain of the second reset transistor (T8) is connected to the low voltage level signal line.

19. The display according to claim 18, wherein the data voltage writing module comprises a data voltage writing transistor (T1), wherein a gate of the data voltage writing transistor (T1) is connected to a gate signal control line, a source of the data voltage writing transistor (T1) is connected to a data signal line, and a drain of the data voltage writing transistor (T1) is connected to the source of the first driving transistor (T5) in the first driving module of the first pixel sub-circuit and the source of the second driving transistor (T6) in the second driving module of the second pixel sub-circuit.

* * * * *